US011590545B2

(12) United States Patent
Ohata et al.

(10) Patent No.: US 11,590,545 B2
(45) Date of Patent: Feb. 28, 2023

(54) COMPOSITE CEMENTED CARBIDE ROLL, AND PRODUCTION METHOD OF COMPOSITE CEMENTED CARBIDE ROLL

(71) Applicant: HITACHI METALS, LTD., Tokyo (JP)

(72) Inventors: Takumi Ohata, Kitakyusyu (JP); Toshiyuki Hattori, Kitakyusyu (JP)

(73) Assignee: HITACHI METALS, LTD., Tokyo (JP)

( * ) Notice: Subject to any disclaimer, the term of this patent is extended or adjusted under 35 U.S.C. 154(b) by 347 days.

(21) Appl. No.: 16/757,971

(22) PCT Filed: Jan. 31, 2019

(86) PCT No.: PCT/JP2019/003404
§ 371 (c)(1),
(2) Date: Apr. 21, 2020

(87) PCT Pub. No.: WO2019/151402
PCT Pub. Date: Aug. 8, 2019

(65) Prior Publication Data

US 2021/0370371 A1 Dec. 2, 2021

(30) Foreign Application Priority Data

Jan. 31, 2018 (JP) ..... JP2018-015990

(51) Int. Cl.
*B21B 27/02* (2006.01)
*B22F 3/15* (2006.01)
(Continued)

(52) U.S. Cl.
CPC ..... *B21B 27/02* (2013.01); *B22F 3/15* (2013.01); *B22F 7/04* (2013.01); *C22C 29/08* (2013.01);
(Continued)

(58) Field of Classification Search
CPC ..... B21B 27/02; B21B 27/032; B21B 27/035; B21B 2203/18; B22F 3/15; B22F 7/04;
(Continued)

(56) References Cited

U.S. PATENT DOCUMENTS 6,258,147 B1 7/2001 Jansson et al.
6,374,494 B1 * 4/2002 Sonobe ..... B21B 27/00 492/58

FOREIGN PATENT DOCUMENTS

JP 51-044502 A 4/1976
JP S5144502 A * 4/1976 ..... B22F 3/00
(Continued)

OTHER PUBLICATIONS

Packard ("Understanding low-alloy steel." The Welder. Sep. 1, 2009) (Year: 2009).*
(Continued)

*Primary Examiner* — Kevin E Yoon
*Assistant Examiner* — Ricardo D Morales
(74) *Attorney, Agent, or Firm* — Sughrue Mion, PLLC

(57) ABSTRACT

A composite cemented carbide roll comprising an inner layer made of an iron-based alloy, and an outer layer made of cemented carbide which is metallurgically bonded to an outer peripheral surface of the inner layer; the cemented carbide of the outer layer comprising 55-90 parts by mass of WC particles and 10-45 parts by mass of an Fe-based binder phase having a particular composition; a shaft member and a shaft end member being metallurgically bonded to at least one axial end of the inner layer; the inner layer being made of an iron-based alloy containing 2.0% or more in total by mass of at least one selected from the group consisting of Cr, Ni and Mo; and the shaft member and the shaft end member
(Continued)

being made of an iron-based alloy containing 1.5% or less in total by mass of at least one selected from the group consisting of Cr, Ni and Mo.

18 Claims, 3 Drawing Sheets

(51) Int. Cl.
*B22F 7/04* (2006.01)
*C22C 29/08* (2006.01)
*C22C 38/44* (2006.01)

(52) U.S. Cl.
CPC ..... *C22C 38/44* (2013.01); *B22F 2007/045* (2013.01); *B22F 2301/35* (2013.01); *B22F 2302/10* (2013.01)

(58) Field of Classification Search
CPC ..... B22F 2007/045; B22F 2301/35; B22F 2302/10; B22F 5/00; B22F 2999/00; B22F 7/08; C22C 29/08; C22C 38/44; C22C 38/34; C22C 38/02; C22C 38/04; C22C 38/40; C22C 38/46; C22C 38/56; C22C 33/0264; C22C 29/067; C22C 29/02; C22C 38/22
See application file for complete search history.

(56) References Cited

FOREIGN PATENT DOCUMENTS

| | | | | | |
|---|---|---|---|---|---|
| JP | 56-069304 | A | | 6/1981 | |
| JP | 60-083708 | A | | 5/1985 | |
| JP | 62-280305 | A | | 12/1987 | |
| JP | S62280305 | A | * | 12/1987 | ..... B21B 27/00 |
| JP | 05-171339 | A | | 7/1993 | |
| JP | 2000-219931 | A | | 8/2000 | |
| JP | 2003-342668 | A | | 12/2003 | |
| JP | 2004-167503 | A | | 6/2004 | |
| JP | 2004-243380 | A | | 9/2004 | |
| JP | 2004243380 | A | * | 9/2004 | ..... B21B 27/00 |

OTHER PUBLICATIONS

JP-2004243380-A and translation (Year: 2004).*
JPS5144502A and translation (Year: 1976).*
JPS62280305A and translation (Year: 1987).*
International Search Report for PCT/JP2019/003404 dated Apr. 2, 2019 [PCT/ISA/210].

* cited by examiner

COMPOSITE CEMENTED CARBIDE ROLL, AND PRODUCTION METHOD OF COMPOSITE CEMENTED CARBIDE ROLL

CROSS REFERENCE TO RELATED APPLICATIONS

This application is a National Stage of International Application No. PCT/JP2019/003404 filed Jan. 31, 2019, claiming priority based on Japanese Patent Application No. 2018-015990 filed Jan. 31, 2018.

FIELD OF THE INVENTION

The present invention relates to a composite cemented carbide roll used for rolling strips, plates, wires, rods, etc. of steel, which comprises an outer layer of cemented carbide metallurgically bonded to an inner layer made of a material having excellent toughness, and a method for producing a composite cemented carbide roll.

BACKGROUND OF THE INVENTION

To meet the requests for higher quality such as improved dimensional accuracy, reduced surface defects, improved surface gloss, etc. of rolled steel, cemented carbide having excellent wear resistance, surface roughening resistance, etc. is used for rolls for rolling wires, rods, plates, etc. of steel. As is known, the cemented carbide is a sintered alloy of tungsten carbide (WC) bonded by a metal binder such as Co, Ni, Fe, etc., and some cemented carbide comprises carbides of Ti, Ta, Nb, etc. in addition to WC.

Because cemented carbide is expensive and difficult to be formed into large products, rolls having a structure in which metal shaft is inserted into a cemented carbide sleeve are disclosed. For example, JP S60-83708 A discloses a method for pressure-fixing a cemented carbide sleeve to a shaft comprising arranging a heat-expanded spacer having a thickness gradually increasing from the inner periphery to the outer periphery around the shaft, together with the cemented carbide sleeve and a disc spring, sandwiching them by fixing members, and cooling the spacer to apply a large lateral pressure to the disk spring, thereby pressing a side surface of the sleeve. However, such a fitting method uses large numbers of members such as a spacer, fixing members, etc. in a complicated assembling structure, needing high assembling accuracy. As a result, it impractically needs a large number of assembling steps and high cost.

To solve the above problems, the applicant discloses by JP 2003-342668 A a composite cemented carbide roll comprising an outer layer made of cemented carbide and an inner layer made of an iron-based alloy which is metallurgically bonded to the outer layer, the outer layer containing 0.05% or less by mass of oxygen, and the inner layer containing 0.06% or more by mass of Cr. Because the cemented carbide and the iron-based alloy have thermal expansion coefficients of about $6\times10^{-6}$/° C. and $12\times10^{-6}$/° C., respectively, different about 2 times, large tensile stress is generated in a bonding boundary between the outer layer and the inner layer when cooled after metallurgical bonding. When rolling is conducted in this state, stress by rolling is added to the tensile stress, resulting in a combined stress applied to the bonding boundary. If the combined stress exceeded the bonding strength of the boundary, it would likely break the roll. Accordingly, to reduce residual tensile stress by generating a bainite or martensite transformation in the inner layer metallurgically bonded to the outer layer, 0.06% or more by mass of Cr, an bainite-forming element, is added to the inner layer.

In Example 3 of JP 2003-342668 A, a solid inner layer 1 made of an iron-based alloy having a composition comprising 0.31% by mass of C, 0.24% by mass of Si, 0.39% by mass of Mn, 3.25% by mass of Ni, and 1.81% by mass of Cr is arranged in a center of a HIP can of 200 mm in inner diameter and 2000 mm in length, and a cemented carbide material for an outer layer comprising 80% by mass of WC and 20% by mass of Co, and a cemented carbide material for an intermediate layer comprising 50% by mass of C and 50% by mass of Co are charged into a space between an outer surface of the inner layer and an inner surface of the HIP can, to conduct hot isostatic pressing (HIP).

A composite cemented carbide roll used for rolling strips can be long though variable depending on strip's widths. Because the outer layer and the inner layer are bonded by HIP, a large HIP furnace should be used to accommodate the entire composite roll. For example, as large a composite cemented carbide roll as more than 200 mm in outer diameter and more than 2000 mm in entire length suffers the problem of a high running cost of a HIP furnace. Further, in the case of a large composite cemented carbide roll having an entire length of more than 4000 mm, there is no HIP furnace capable of containing the composite roll, failing to produce a composite cemented carbide roll practically.

Also, JP H5-171339 A discloses a WC—Co—Ni—Cr cemented carbide, in which WC+Cr is 95% or less by weight, Co+Ni is less than 10% by weight, and Cr/Co+Ni+Cr is 2-40% by weight. JP H5-171339 A describes that because cemented carbide having such a composition has higher wear resistance and toughness than those of conventional composition alloys, it can be used for hot-rolling rolls and guide rollers, largely contributing to the reduction of a roll cost, such as increase in the rolling amount per caliber, the reduction of grinding amount, the reduction of breakage, etc. However, the rolling roll of cemented carbide composed of WC particles and a Co—Ni—Cr binder phase fails to conduct sufficient cold rolling of steel strips. Intensive research has revealed that such insufficient cold rolling is caused by in sufficient reduction of a steel strip, because the cemented carbide having a Co—Ni—Cr binder phase has as low compressive yield strength as 300-500 MPa, suffering fine dents due to yield on the roll surface during the cold rolling of steel strips.

JP 2000-219931 A discloses a cemented carbide comprising 50-90% by mass of submicron WC and a binder phase having hardenability, the binder phase comprising 10-60% by mass of Co, less than 10% by mass of Ni, 0.2-0.8% by mass of C, and Cr and W and optionally Mo and/or V, in addition to Fe, the molar ratios $X_C$, $X_{Cr}$, $X_W$, $X_{Mo}$ and $X_V$ of C, Cr, W, Mo and V in the binder phase meeting $2X_C<X_W+X_{Cr}+X_{Mo}+X_V<2.5X_C$, and the Cr content (% by mass) meeting 0.03<Cr/[100−WC (% by mass)]<0.05. JP 2000-219931 A describes that this cemented carbide has high wear resistance by the binder phase having hardenability. However, because this cemented carbide contains 10-60% by mass of Co in the binder phase, it has low hardenability, failing to exhibit sufficient compressive yield strength. Further, as fine WC particles as submicron provide this cemented carbide with poor toughness and thus poor cracking resistance, so that it is not usable for outer layers of rolling rolls.

In view of the above circumstances, a long composite cemented carbide roll having sufficient compressive yield strength, thereby less suffering dents on the roll surface due to yield even when used in the cold rolling of metal strips, and capable of being produced at low cost, is desired.

OBJECTS OF THE INVENTION

Accordingly, an object of the present invention is to provide a composite cemented carbide roll having high wear resistance and mechanical strength, which suffers less dents on the roll surface even in the cold rolling of metal strips, by forming an outer layer by cemented carbide having sufficient compressive yield strength.

Another object of the present invention is to provide a low-cost, long, composite cemented carbide roll capable of being used for rolling strips, particularly to a long, composite cemented carbide roll having a roll diameter of more than 200 mm and an entire length of more than 2000 mm.

SUMMARY OF THE INVENTION

In view of the above objects, the inventors have solved the above problems by conducting intensive research on the compositions of outer and inner layers and the composition of an iron-based alloy for a shaft. The present invention has been completed based on such finding.

Thus, the first composite cemented carbide roll of the present invention comprises an inner layer made of an iron-based alloy, and an outer layer of cemented carbide metallurgically bonded to an outer peripheral surface of the inner layer;

the cemented carbide forming the outer layer comprising 55-90 parts by mass of WC particles and 10-45 parts by mass of an Fe-based binder phase, and a binder phase in the outer layer having a chemical composition comprising 0.5-10% by mass of Ni, 0.2-2.0% by mass of C, 0.5-5% by mass of Cr, and 0.1-5% by mass of W, the balance being Fe and inevitable impurities;

a shaft member being metallurgically bonded to at least one axial end of the inner layer, and a shaft end member being welded to the shaft member;

the inner layer being made of an iron-based alloy containing 2.0% or more in total by mass of at least one selected from the group consisting of Cr, Ni and Mo; and the shaft member and the shaft end member being made of an iron-based alloy containing 1.5% or less in total by mass of at least one selected from the group consisting of Cr, Ni and Mo.

In the first composite cemented carbide roll of the present invention, the cemented carbide forming the outer layer preferably contains substantially no composite carbides having equivalent circle diameters of 5 μm or more.

In the first composite cemented carbide roll of the present invention, the WC particles contained in the cemented carbide forming the outer layer preferably have a median diameter D50 of 0.5-10 μm.

In the first composite cemented carbide roll of the present invention, the binder phase in the cemented carbide forming the outer layer preferably further comprises 0.2-2.0% by mass of Si, 0-5% by mass of Co, and 0-1% by mass of Mn.

In the first composite cemented carbide roll of the present invention, the total amount of bainite phases and/or martensite phases in the binder phase in the cemented carbide forming the outer layer is preferably 50% or more by area.

The second composite cemented carbide roll of the present invention comprises an inner layer made of an iron-based alloy, an intermediate layer of cemented carbide metallurgically bonded to an outer peripheral surface of the inner layer, and an outer layer of cemented carbide bonded to an outer peripheral surface of the intermediate layer;

the cemented carbide forming the outer layer comprising 55-90 parts by mass of WC particles and 10-45 parts by mass of an Fe-based binder phase, and a binder phase in the outer layer having a chemical composition comprising 0.5-10% by mass of Ni, 0.2-2.0% by mass of C, 0.5-5% by mass of Cr, and 0.1-5% by mass of W, the balance being Fe and inevitable impurities;

the cemented carbide forming the intermediate layer comprising 30-65 parts by mass of WC particles and 35-70 parts by mass of an Fe-based binder phase, and a binder phase in the intermediate layer having a chemical composition comprising 0.5-10% by mass of Ni, 0.2-2.0% by mass of C, 0.5-5% by mass of Cr, and 0.1-5% by mass of W, the balance being Fe and inevitable impurities;

a shaft member being metallurgically bonded to at least one axial end of the inner layer, and a shaft end member being welded to the shaft member;

the inner layer being made of an iron-based alloy containing 2.0% or more in total by mass of at least one selected from the group consisting of Cr, Ni and Mo; and the shaft member and the shaft end member being made of an iron-based alloy containing 1.5% or less in total by mass of at least one selected from the group consisting of Cr, Ni and Mo.

In the second composite cemented carbide roll of the present invention, the cemented carbide forming the outer layer and/or the intermediate layer preferably contains substantially no composite carbides having equivalent circle diameters of 5 μm or more.

In the second composite cemented carbide roll of the present invention, the WC particles in the cemented carbide forming the outer layer and/or the intermediate layer preferably have a median diameter D50 of 0.5-10 μm.

In the second composite cemented carbide roll of the present invention, the binder phase in the cemented carbide forming the outer layer and/or the intermediate layer preferably further contains 0.2-2.0% by mass of Si, 0-5% by mass of Co, and 0-1% by mass of Mn.

In the second composite cemented carbide roll of the present invention, the total amount of bainite phases and/or martensite phases in the binder phase in the cemented carbide forming the outer layer and/or the intermediate layer is preferably 50% or more by area.

In the first and second composite cemented carbide rolls of the present invention, the inner layer is preferably made of an iron-based alloy comprising 0.2-0.45% by mass of C, 0.5-4.0% by mass of Cr, 1.4-4.0% by mass of Ni, and 0.10-1.0% by mass of Mo, the balance being Fe and inevitable impurities.

In the first and second composite cemented carbide rolls of the present invention, the shaft member and the shaft end member are preferably made of an iron-based alloy comprising 0.2-0.58% by mass of C, 0-1.2% by mass of Cr, and 0-0.3% by mass of Mo, the balance being Fe and inevitable impurities.

The first method of the present invention for producing the first composite cemented carbide roll comprising an inner layer made of an iron-based alloy, and an outer layer of cemented carbide metallurgically bonded to the inner layer comprises arranging an outer layer material which is a powder, green body, calcined body or sintered body of cemented carbide, around the inner layer made of an iron-based alloy containing 2.0% or more in total by mass of at least one selected from the group consisting of Cr, Ni and Mo;

abutting a shaft member made of an iron-based alloy containing 1.5% or less in total by mass of at least one selected from the group consisting of Cr, Ni and Mo, on at least one axial end of the inner layer;

sealing the outer layer material, the inner layer and the shaft member in a HIP can made of a steel material, and evacuating the HIP can; and conducting a HIP treatment to integrally bond the outer layer material, the inner layer, and the shaft member.

In the first production method of the present invention, the cemented carbide forming the outer layer preferably comprises 55-90 parts by mass of WC particles, and 10-45 parts by mass of an Fe-based binder phase; and the binder phase in the outer layer preferably has a chemical composition comprising 0.5-10% by mass of Ni, 0.2-2.0% by mass of C, 0.5-5% by mass of Cr, and 0.1-5% by mass of W, the balance being Fe and inevitable impurities.

The second method of the present invention for producing the second composite cemented carbide roll comprising an inner layer made of an iron-based alloy, an intermediate layer made of cemented carbide, and an outer layer made of cemented carbide, which are metallurgically bonded to each other, comprises arranging an intermediate layer material which is a powder, green body, calcined body or sintered body of cemented carbide, and an outer layer material which is a powder, green body, calcined body or sintered body of cemented carbide, around the inner layer made of an iron-based alloy containing 2.0% or more in total by mass of at least one selected from the group consisting of Cr, Ni and Mo;

abutting a shaft member made of an iron-based alloy containing 1.5% or less in total by mass of at least one selected from the group consisting of Cr, Ni and Mo on at least one axial end of the inner layer;

sealing the outer layer material, the intermediate layer material, the inner layer and the shaft member in a HIP can made of a steel material, and evacuating the HIP can; and conducting a HIP treatment to integrally bond the outer layer material, the intermediate layer material, the inner layer, and the shaft member.

It is preferable that in the second production method of the present invention, the cemented carbide forming the outer layer comprises 55-90 parts by mass of WC particles and 10-45 parts by mass of an Fe-based binder phase, the binder phase in the outer layer having a chemical composition comprising 0.5-10% by mass of Ni, 0.2-2.0% by mass of C, 0.5-5% by mass of Cr, and 0.1-5% by mass of W, the balance being Fe and inevitable impurities; and the cemented carbide forming the intermediate layer comprises 30-65 parts by mass of WC particles and 35-70 parts by mass of an Fe-based binder phase, the binder phase in the intermediate layer having a chemical composition comprising 0.5-10% by mass of Ni, 0.2-2.0% by mass of C, 0.5-5% by mass of Cr, and 0.1-5% by mass of W, the balance being Fe and inevitable impurities.

In the first and second methods of the present invention for producing the composite cemented carbide roll, after the HIP treatment, a shaft end member made of an iron-based alloy containing 1.5% or less in total by mass of at least one selected from the group consisting of Cr, Ni and Mo is preferably welded to the shaft member.

Effects of the Invention

The composite cemented carbide roll of the present invention can conduct the high-quality, continuous cold rolling of steel strips, and a long roll having a diameter of more than 200 mm and an entire length of 2000 mm or more can be obtained at low cost.

In the production of a composite cemented carbide roll, a material for an inner layer should be selected to reduce residual stress in a boundary between the outer layer made of cemented carbide and the inner layer made of an iron-based alloy, but such inner layer actually suffers excessive residual stress due to large difference in thermal shrinkage from that of the cemented carbide of the outer layer having a small thermal expansion coefficient, failing to withstand actual rolling because of insufficient strength, or likely being broken during production. To avoid these problems, it is effective to cancel the thermal shrinkage of the inner layer by the transformation expansion of martensite, etc. during cooling after HIP bonding. To this end, 2% or more in total of alloy elements such as Cr, Ni and Mo contributing to improvement in hardenability should be added to the inner layer. On the other hand, because high-alloy steel for such inner layer is not resistant to cracking by welding, it is not easy to weld a shaft end member to the inner layer after HIP to obtain a necessary length, when the inner layer cannot achieve the necessary length due to the limitation of the HIP capacity. According to the present invention, which selects a shaft member made of an iron-based alloy containing small amounts of Cr, Ni and Mo which is suitable for welding by HIP, and abuts the shaft member on an end of the inner layer, and integrally bonds them by HIP, the roll is less likely broken when used for rolling, and a shaft portion can be elongated by welding to obtain a long composite cemented carbide roll at low cost.

DESCRIPTION OF THE PREFERRED EMBODIMENTS

Figure 1:
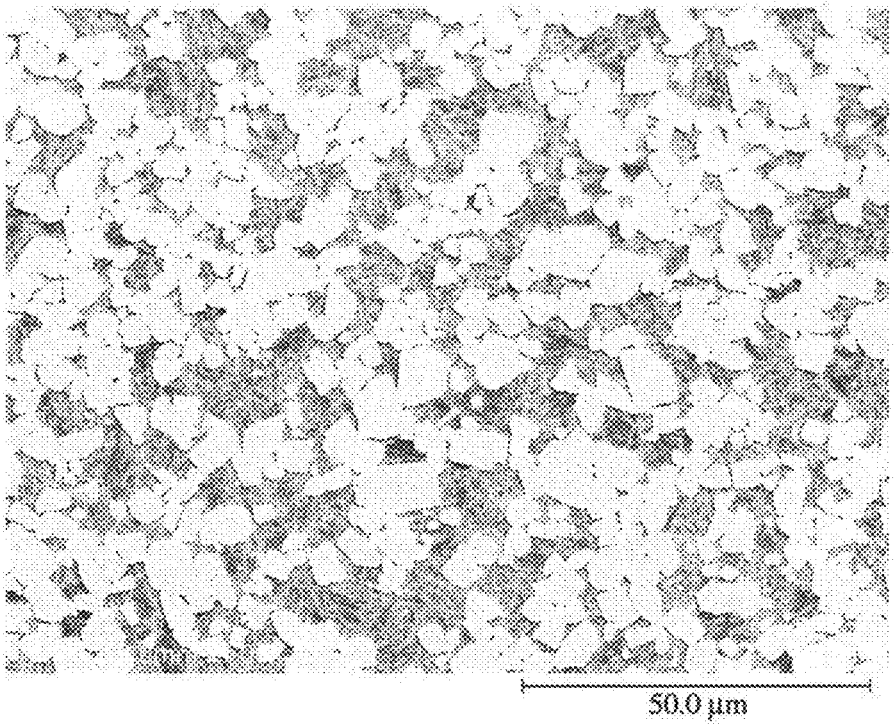
FIG. 1 is SEM photograph showing a cross section structure of the cemented carbide of Sample 2.

The embodiments of the present invention will be explained in detail below. Explanations of one embodiment may be applicable to other embodiments unless otherwise mentioned. The following explanations are not restrictive, but various modifications may be made within the scope of the present invention.

[1] Composite Cemented Carbide Roll

The first composite cemented carbide roll of the present invention comprises an inner layer made of an iron-based alloy, and an outer layer made of cemented carbide, which is metallurgically bonded to an outer peripheral surface of the inner layer;

the cemented carbide comprising 55-90 parts by mass of WC particles and 10-45 parts by mass of an Fe-based binder phase, and a binder phase in the outer layer having a chemical composition comprising 0.5-10% by mass of Ni, 0.2-2.0% by mass of C, 0.5-5% by mass of Cr, and 0.1-5% by mass of W, the balance being Fe and inevitable impurities;

a shaft member being metallurgically bonded to at least one axial end of the inner layer, and a shaft end member being welded to the shaft member;

the inner layer being made of an iron-based alloy containing 2.0% or more in total by mass of at least one selected from the group consisting of Cr, Ni and Mo; and the shaft member and the shaft end member being made of an iron-based alloy containing 1.5% or less in total by mass of at least one selected from the group consisting of Cr, Ni and Mo.

The second composite cemented carbide roll of the present invention comprises an inner layer made of an iron-based alloy, an intermediate layer made of cemented carbide which is metallurgically bonded to an outer peripheral surface of the inner layer, and an outer layer made of cemented carbide which is bonded to an outer peripheral surface of the intermediate layer;

the cemented carbide forming the outer layer comprising 55-90 parts by mass of WC particles and 10-45 parts by mass of an Fe-based binder phase, a binder phase in the outer layer having a chemical composition comprising 0.5-10% by mass of Ni, 0.2-2.0% by mass of C, 0.5-5% by mass of Cr, and 0.1-5% by mass of W, the balance being Fe and inevitable impurities;

the cemented carbide forming the intermediate layer comprising 30-65 parts by mass of WC particles and 35-70 parts by mass of an Fe-based binder phase, a binder phase in the intermediate layer having a chemical composition comprising 0.5-10% by mass of Ni, 0.2-2.0% by mass of C, 0.5-5% by mass of Cr, and 0.1-5% by mass of W, the balance being Fe and inevitable impurities;

a shaft member being metallurgically bonded to at least one axial end of the inner layer, and a shaft end member being welded to the shaft member;

the inner layer being made of an iron-based alloy containing 2.0% or more in total by mass of at least one selected from the group consisting of Cr, Ni and Mo; and the shaft member and the shaft end member being made of an iron-based alloy containing 1.5% or less in total by mass of at least one selected from the group consisting of Cr, Ni and Mo.

[1-1] Cemented Carbide Forming Outer and Intermediate Layers

The cemented carbide forming the outer layer in the first composite cemented carbide roll, and the cemented carbide forming the outer and intermediate layers in the second composite cemented carbide roll will be explained below. It should be noted that the outer layers in the first and second composite cemented carbide rolls have the same composition unless otherwise mentioned.

(A) Composition

The cemented carbide forming the outer layer in the first and second composite cemented carbide rolls comprises 55-90 parts by mass of WC particles and 10-45 parts by mass of an Fe-based binder phase, and the cemented carbide forming the intermediate layer in the second composite cemented carbide roll comprises 30-65 parts by mass of WC particles and 35-70 parts by mass of an Fe-based binder phase.

The amount c1 of WC particles in the cemented carbide forming the outer layer is 55-90 parts by mass. When WC particles are less than 55 parts by mass in the outer layer, the amount of hard WC particles is relatively small, providing the cemented carbide with too low Young's modulus. On the other hand, when WC particles are more than 90 parts by mass, the amount of the binder phase is relatively small, failing to provide the cemented carbide with enough strength. The lower limit of the amount of WC particles in the outer layer is preferably 60 parts by mass, and more preferably 65 parts by mass. Also, the upper limit of the amount of WC particles in the outer layer is preferably 85 parts by mass.

To improve both the bonding strength of a boundary between the outer layer and the intermediate layer and the bonding strength of a boundary between the inner layer and the intermediate layer, while reducing circumferential and axial residual stress in or near the bonding boundaries, the amount c2 of WC particles in the cemented carbide forming the intermediate layer is 30-65 parts by mass. The lower limit of the amount of WC particles in the intermediate layer is preferably 33 parts by mass, and more preferably 35 parts by mass. Also, the upper limit of the amount of WC particles in the intermediate layer is preferably 60 parts by mass, and more preferably 55 parts by mass.

Further, the amounts of WC particles in the outer and intermediate layers are set, such that the amount c1 (parts by mass) of WC particles in the outer layer and the amount c2 (parts by mass) of WC particles in the intermediate layer meet the formula of $0.45 \leq c2/c1 \leq 0.85$. In the second composite cemented carbide roll of the present invention, in which the outer layer, the intermediate layer and the inner layer are metallurgically and integrally bonded by HIP as described below, by setting the amounts of WC particles in the outer and intermediate layers as described above, the thermal shrinkage of the intermediate layer can be made intermediate between those of the outer and inner layers, thereby reducing residual stress in a cooling process after HIP. The lower limit of c2/c1 is preferably 0.5, and more preferably 0.55. Also, the upper limit of c2/c1 is preferably 0.8, and more preferably 0.75.

(1) WC Particles

WC particles contained in the cemented carbides forming the outer layer and the intermediate layer preferably have a median diameter D50 (corresponding to a particle size at a cumulative volume of 50%) of 0.5-10 μm. When the average particle size is less than 0.5 μm, there are increased boundaries between the WC particles and the binder phase, making it likely to generate composite carbides described below, thereby reducing the strength of the cemented carbide. On the other hand, when the average particle size exceeds 10 μm, the strength of the cemented carbide is lowered. The lower limit of the median diameter D50 of WC particles is preferably 1 μm, more preferably 2 μm, and most preferably 3 μm. Also, the upper limit of the median diameter D50 of WC particles is preferably 9 μm, more preferably 8 μm, and most preferably 7 μm.

Because WC particles densely exist in a connected manner in the cemented carbide, it is difficult to determine the particle sizes of WC particles on the photomicrograph. Because the cemented carbide used in the present invention is produced by sintering a green body at a temperature between (liquid phase generation-starting temperature) and (liquid phase generation-starting temperature+100° C.) in vacuum as described below, there is substantially no particle size difference between WC powder in the green body and WC particles in the cemented carbide. Accordingly, the particle sizes of WC particles dispersed in the cemented carbide are expressed by the particle sizes of WC powder in the green body.

WC particles preferably have relatively uniform particle sizes. Accordingly, in a cumulative particle size distribution curve determined by a laser diffraction and scattering method, the WC particles have a preferable particle size distribution defined below. The lower limit of D10 (particle size at a cumulative volume of 10%) is preferably 0.3 μm, and more preferably 1 μm, and the upper limit of D10 is preferably 3 μm. Also, the lower limit of D90 (particle size at a cumulative volume of 90%) is preferably 3 μm, and more preferably 6 μm, and the upper limit of D90 is preferably 12 μm, and more preferably 8 μm. The median diameter D50 is as described above.

WC particles contained in the outer layer and the intermediate layer may be the same or different as long as they meet the above particle size distribution, though the use of the same WC particles is preferable.

(2) Binder Phase

In the cemented carbide forming the outer layer and the intermediate layer, the binder phase has a composition comprising 0.5-10% by mass of Ni, 0.2-2% by mass of C, 0.5-5% by mass of Cr, and 0.1-5% by mass of W, the balance being Fe and inevitable impurities.

(i) Indispensable Elements (a) Ni: 0.5-10% by mass

Ni is an element necessary for securing the hardenability of the binder phase. When Ni is less than 0.5% by mass, the binder phase has insufficient hardenability, likely lowering the material strength. On the other hand, when Ni exceeds 10% by mass, the binder phase is turned to have an austenite phase, resulting in cemented carbide having no sufficient compressive yield strength. The lower limit of the Ni content is preferably 2.0% by mass, more preferably 2.5% by mass, further preferably 3% by mass, and most preferably 4% by mass. Also, the upper limit of the Ni content is preferably 8% by mass, and more preferably 7% by mass.

(b) C: 0.2-2.0% by mass

C is an element necessary for securing the hardenability of the binder phase and suppressing the generation of composite carbides. When C is less than 0.2% by mass, the binder phase has insufficient hardenability, and large amounts of composite carbides are generated, resulting in low material strength. On the other hand, when C exceeds 2.0% by mass, coarse composite carbides are generated, providing the cemented carbide with low strength. The lower limit of the C content is preferably 0.3% by mass, and more preferably 0.5% by mass, and the upper limit of the C content is preferably 1.5% by mass, and more preferably 1.0% by mass.

(c) Cr: 0.5-5% by mass

Cr is an element necessary for securing the hardenability of the binder phase. When Cr is less than 0.5% by mass, the binder phase has too low hardenability, failing to obtain sufficient compressive yield strength. On the other hand, when Cr exceeds 5% by mass, coarse composite carbides are generated, providing the cemented carbide with low strength. Cr is preferably 4% or less by mass, and more preferably 3% or less by mass.

(d) W: 0.1-5% by mass

The W content in the binder phase is 0.1-5% by mass. When the W content in the binder phase exceeds 5% by mass, coarse composite carbides are generated, providing the cemented carbide with low strength. The lower limit of the W content is preferably 0.8% by mass, and more preferably 1.2% by mass. Also, the upper limit of the W content is preferably 4% by mass.

(ii) Optional Elements (a) Si: 0.2-2.0% by mass

Si, which is an element strengthening the binder phase, may be contained if necessary. Less than 0.2% by mass of Si has substantially no effect of strengthening the binder phase. On the other hand, when Si is more than 2.0% by mass, graphite is likely crystallized, providing the cemented carbide with low strength. Accordingly, Si is preferably 0.2% or more and 2.0% or less by mass, if contained. A further effect of strengthening the binder phase is exhibited when the Si content is 0.3% or more by mass, particularly when it is 0.5% or more by mass. Also, the upper limit of the Si content is preferably 1.9% by mass.

(b) Co: 0-5% by mass

Co, which has a function of improving sinterability, is not indispensable in the cemented carbide used in the present invention. Namely, the Co content is preferably substantially 0% by mass. However, 5% or less by mass of Co does not affect the structure and strength of the cemented carbide. The upper limit of the Co content is more preferably 2% by mass, and most preferably 1% by mass.

(c) Mn: 0-5% by mass

Mn, which has a function of improving hardenability, is not indispensable in the cemented carbide used in the present invention. Namely, the Mn content is preferably substantially 0% by mass. However, 5% or less by mass of Mn does not affect the structure and strength of the cemented carbide. The upper limit of the Mn content is more preferably 2% by mass, and most preferably 1% by mass.

(iii) Inevitable Impurities

The inevitable impurities include Mo, V, Nb, Ti, Al, Cu, N, O, etc. Among them, at least one selected from the group consisting of Mo, V and Nb is preferably 2% or less by mass in total. At least one selected from the group consisting of Mo, V and Nb is more preferably 1% or less by mass, and most preferably 0.5% or less by mass, in total. Also, at least one selected from the group consisting of Ti, Al, Cu, N and O is preferably 0.5% or less by mass alone and 1% or less by mass in total. Particularly, each of N and O is preferably less than 1000 ppm. The inevitable impurities within the above ranges do not substantially affect the structure and strength of the cemented carbide.

Though the binder phases in the cemented carbides forming the outer layer and the intermediate layer may have the same or different compositions, they preferably have the same composition.

(B) Structure (1) Composite Carbides

The cemented carbides forming the outer layer and the intermediate layer preferably contain substantially no composite carbides having equivalent circle diameters of 5 μm or more. The composite carbides are those of W and metal elements, for example, $(W, Fe, Cr)_{23}C_6$, $(W, Fe, Cr)_3C$, $(W, Fe, Cr)_2C$, $(W, Fe, Cr)_7C_3$, $(W, Fe, Cr)_6C$, etc. Herein, the equivalent circle diameter of a composite carbide is a diameter of a circle having the same area as that of the composite carbide particle in a photomicrograph (about 1000 times) of a polished cross section of the cemented carbide. The cemented carbide containing no composite carbides having equivalent circle diameters of 5 μm or more in the binder phase has bending strength of 1700 MPa or more. Herein, "containing substantially no composite carbides" means that composite carbides having equivalent circle diameters of 5 μm or more are not observed on a SEM photograph (1000 times). Composite carbides having equivalent circle diameters of less than 5 μm may exist in an amount of less than about 5% by area when measured by EPMA, in the cemented carbides forming the outer layer and the intermediate layer of the composite cemented carbide roll of the present invention.

(2) Bainite Phases and/or Martensite Phases

The binder phases in the cemented carbides forming the outer layer and the intermediate layer preferably have a structure containing 50% or more in total by area of bainite phases and/or martensite phases. The use of the term "bainite phases and/or martensite phases" is due to the fact that bainite phases and martensite phases have substantially the same function, and that it is difficult to distinguish them on a photomicrograph. With such structure, the cemented carbides forming the outer layer and the intermediate layer in the composite cemented carbide roll of the present invention have high compressive yield strength and mechanical strength.

Because the total amount of bainite phases and/or martensite phases in the binder phase is 50% or more by area, the cemented carbide has compressive yield strength of 1200 MPa or more. The total amount of bainite phases and/or martensite phases is preferably 70% or more by area, more preferably 80% or more by area, and most preferably substantially 100% by area. Other phases than bainite phases and martensite phases are pearlite phases, austenite phases, etc.

(3) Diffusion of Fe into WC Particles

EPMA analysis has revealed that in the cemented carbides forming the outer layer and the intermediate layer in the composite cemented carbide roll of the present invention, WC particles contain 0.3-0.7% by mass of Fe.

The generation of dents on the roll surface can be suppressed in the outer layer of the cemented carbide roll of the present invention when used for the cold rolling of metal strips.

(C) Properties

The cemented carbide having the above composition and structure has compressive yield strength of 1200 MPa or more and bending strength of 1700 MPa or more. Accordingly, when a rolling roll having an outer layer (and an intermediate layer) made of such cemented carbide is used for the cold rolling of metal (steel) strips, dents due to the compressive yield of the roll surface can be reduced, enabling the continuous high-quality rolling of metal strips with a long life span of the rolling roll. Of course, the composite cemented carbide roll of the present invention can also be used for the hot rolling of metal strips.

Figure 2:
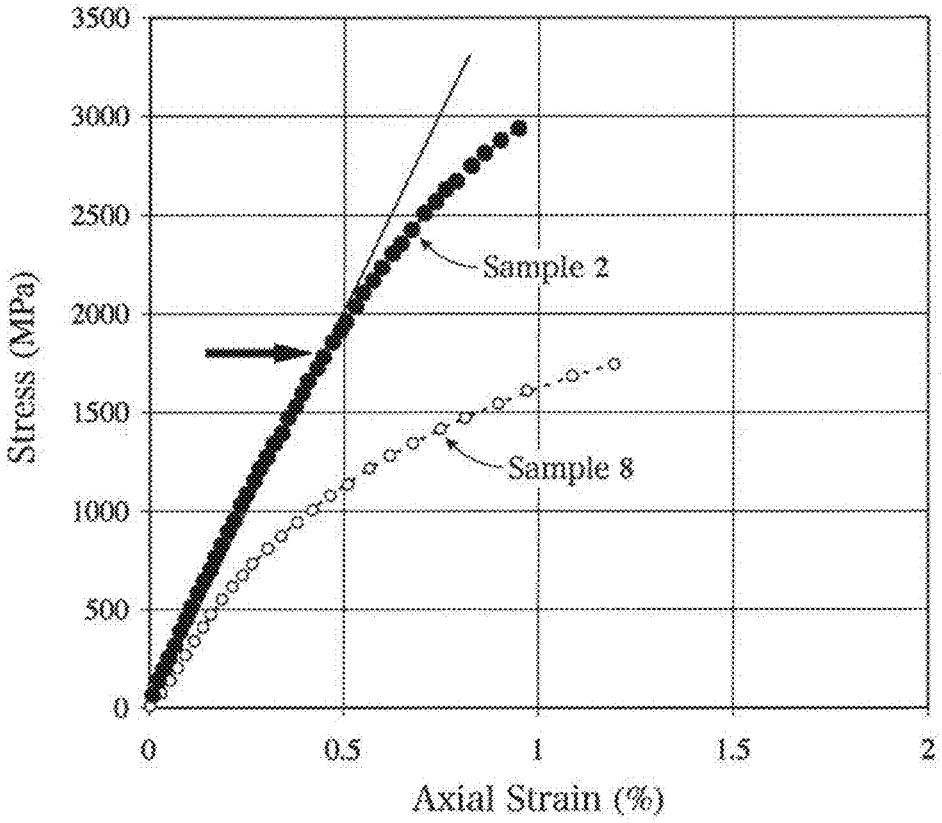
FIG. 2 is a graph showing the stress-strain curves of Samples 2 and 8, which were obtained by a uniaxial compression test.
Figure 3:
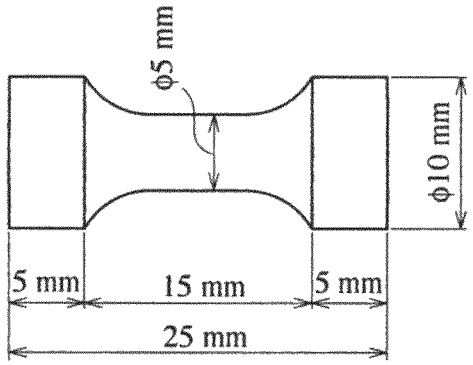
FIG. 3 is a schematic view showing a test piece used in the uniaxial compression test.

The compressive yield strength is yield stress determined by a uniaxial compression test of a test piece shown in FIG. 3 under an axial load. Namely, in a stress-strain curve as shown in FIG. 2, which is determined by the uniaxial compression test, a stress at a point at which the stress and the strain deviate from a straight linear relation is defined as the compressive yield strength.

The cemented carbides forming the outer layer and the intermediate layer have compressive yield strength of more preferably 1500 MPa or more, and most preferably 1600 MPa or more, and bending strength of more preferably 2000 MPa or more, and most preferably 2300 MPa or more.

The cemented carbides forming the outer layer and the intermediate layer further have Young's modulus of 385 GPa or more and Rockwell hardness of 80 HRA or more. The Young's modulus is preferably 400 GPa or more, and more preferably 450 GPa or more. Also, the Rockwell hardness is preferably 82 HRA or more.

[1-2] Inner Layer

The inner layer is made of an iron-based alloy having excellent toughness, which contains 2.0% or more in total by mass of at least one selected from the group consisting of Cr, Ni and Mo. Using such an iron-based alloy for the inner layer, bainite or martensite transformation can occur in the inner layer in a cooling process after the metallurgical bonding of the outer layer, the intermediate layer and the inner layer, thereby reducing the thermal expansion difference between the inner layer and the low-thermal expansion cemented carbide to reduce residual stress in the outer and intermediate layers.

The iron-based alloy for the inner layer preferably comprises 0.2-0.45% by mass of C, 0.5-4.0% by mass of Cr, 1.4-4.0% by mass of Ni, and 0.10-1.0% by mass of Mo, the balance being Fe and inevitable impurities.

(a) C: 0.2-0.45% by mass

C is an indispensable element alloyed with Fe to obtain good mechanical properties. When C is less than 0.2% by mass, the iron-based alloy has a high melting point, likely suffering defects. For relatively inexpensive production, C should be 0.2% or more by mass. When C exceeds 0.45% by mass, the iron-based alloy becomes harder, resulting in low toughness.

(b) Cr: 0.5-4.0% by mass

Cr is an element necessary for increasing the strength and hardenability of the material by alloying, making bainite or martensite transformation easier. When Cr is less than 0.5% by mass, sufficient strength cannot be obtained. Though Cr is effective for increasing hardenability and reducing residual stress, its amount may be 4% or less by mass. Because the addition of more Cr is disadvantageous in cost, the upper limit of Cr is 4% by mass.

(c) Ni: 1.4-4.0% by mass

Ni is an element effective for improving hardenability and making bainite or martensite transformation easier, and mainly reducing residual stress. Less than 1.4% by mass of Ni provides insufficient effect, while more than 4.0% by mass of Ni stabilizes austenite too much, making the transformation difficult.

(d) Mo: 0.1-1.0% by mass

Mo increases the strength and hardenability of the material, and is effective for making bainite or martensite transformation easier. When Mo added together with Cr and Ni for the above purpose is less than 0.1% by mass, its effect is insufficient. On the other hand, when Mo exceeds 1.0% by mass, the material becomes brittle.

Specific examples of the iron-based alloy used for the inner layer include nickel chromium molybdenum steels such as SNCM439, SNCM630, etc.

[1-3] Shaft Member and Shaft End Member

An iron-based alloy containing 1.5% or less in total by mass of at least one selected from the group consisting of Cr, Ni and Mo is used for the shaft member and the shaft end member. The shaft member and the shaft end member should have sufficient strength and wear resistance, because they are used as shafts bonded to the inner layer of the composite cemented carbide roll. Further, because the shaft end member is welded to the shaft member, the shaft member should be made of a material having good weldability to the shaft end member. Using the iron-based alloy containing 1.5% or less in total by mass of at least one selected from the group consisting of Cr, Ni and Mo, the shaft end member can be easily welded to an end of the shaft member after the HIP treatment, to obtain a long composite cemented carbide roll.

The iron-based alloy used for the shaft member and the shaft end member preferably comprises 0.2-0.58% by mass of C, 0-1.2% by mass of Cr, and 0-0.3% by mass of Mo, the balance being Fe and inevitable impurities. Though the shaft member and the shaft end member may have the same or different compositions, they preferably have the same composition from the aspect of weldability.

(a) C: 0.2-0.58% by mass

C is necessary for obtaining enough yield strength and hardness for the shaft member and the shaft end member. When C is less than 0.2% by mass, it is difficult to obtain sufficient strength and hardness. When C exceeds 0.58% by mass, cracking likely occurs in welding, making welding difficult.

(b) Cr: 0-1.2% by mass

Cr is effective for obtaining enough strength for the shaft member and the shaft end member. More than 1.2% by mass of Cr provides excessive hardenability, so that cracking likely occurs in welding.

(c) Mo: 0-0.3% by mass

Mo is effective for obtaining enough strength for the shaft member and the shaft end member. More than 0.3% by mass of Mo provides excessive hardenability, so that cracking likely occurs in welding.

Specific examples of the iron-based alloy used for the shaft member and the shaft end member include structural carbon steels such as S45C, S55C, etc., and chromium molybdenum steels such as SCM440, etc.

The bonding strength of a boundary between the inner layer and the shaft member is preferably 600 MPa or more in tensile strength.

[2] Production Method of Cemented Carbide (1) Method of Using Sintered Body of Cemented Carbide The production method of cemented carbide will be explained first in a case where a sintered body of cemented carbide is used for the outer layer (and the intermediate layer).

(A-1) Powder for Molding (Outer Layer)

55-90 parts by mass of WC powder, and 10-45 parts by mass of a metal powder comprising 2.5-10% by mass of Ni, 0.3-1.7% by mass of C, 0.5-5% by mass of Cr, 0.2-2.0% by mass of Si, 0-5% by mass of Co, and 0-2% by mass of Mn, the balance being Fe and inevitable impurities, are wet-mixed in a ball mill, etc., and dried to prepare a powder for molding of the cemented carbide. Because W is diffused from the WC powder to the binder phase during sintering, the metal powder may not contain W. The WC powder content is preferably 60-90 parts by mass, and more preferably 65-90 parts by mass. The upper limit of the WC powder content is preferably 85 parts by mass. To prevent the generation of composite carbides, C in the metal powder should be 0.3-1.7% by mass, and is preferably 0.5-1.5% by mass.

(A-2) Powder for Molding (Intermediate Layer)

30-65 parts by mass of WC powder, and 35-70 parts by mass of a metal powder comprising 2.5-10% by mass of Ni, 0.3-1.7% by mass of C, 0.5-5% by mass of Cr, 0.2-2.0% by mass of Si, 0-5% by mass of Co, and 0-2% by mass of Mn, the balance being Fe and inevitable impurities, are wet-mixed in a ball mill, etc., and dried to prepare the powder for molding of the cemented carbide. Because W is diffused from WC powder to the binder phase during sintering, the metal powder may not contain W. The WC powder content is preferably 33-65 parts by mass, and more preferably 35-65 parts by mass. The upper limit of the WC powder content is preferably 60 parts by mass. To prevent the generation of composite carbides, C in the metal powder should be 0.3-1.7% by mass, and is preferably 0.5-1.5% by mass.

The metal powder for forming the binder phases in the outer and intermediate layers may be a mixture of constituent element powders, or alloy powder containing all constituent elements. Carbon may be added in the form of powder such as graphite, carbon black, etc., or may be added to powder of each metal or alloy. Cr may be added in the form of an alloy with Si, for example, $CrSi_2$. Each metal or alloy powder, for example, Fe powder, Ni powder, Co powder, Mn powder and $CrSi_2$ powder, preferably has a median diameter D50 of 1-10 μm.

(B) Molding

In the production of the first composite cemented carbide roll, the powder for molding the outer layer is molded by a method such as die-pressing, cold-isostatic pressing (CIP), etc., to obtain a sleeve-shaped green body for the outer layer, which is bonded to an outer peripheral surface of the inner layer. Also, in the second composite cemented carbide roll, the powders for molding the outer and intermediate layers are molded by a method such as die-pressing, cold-isostatic pressing (CIP), etc., to obtain sleeve-shaped green bodies for the intermediate and outer layers, the outer layer being bonded to an outer peripheral surface of the inner layer via the intermediate layer.

(C) Sintering

Figure 4:
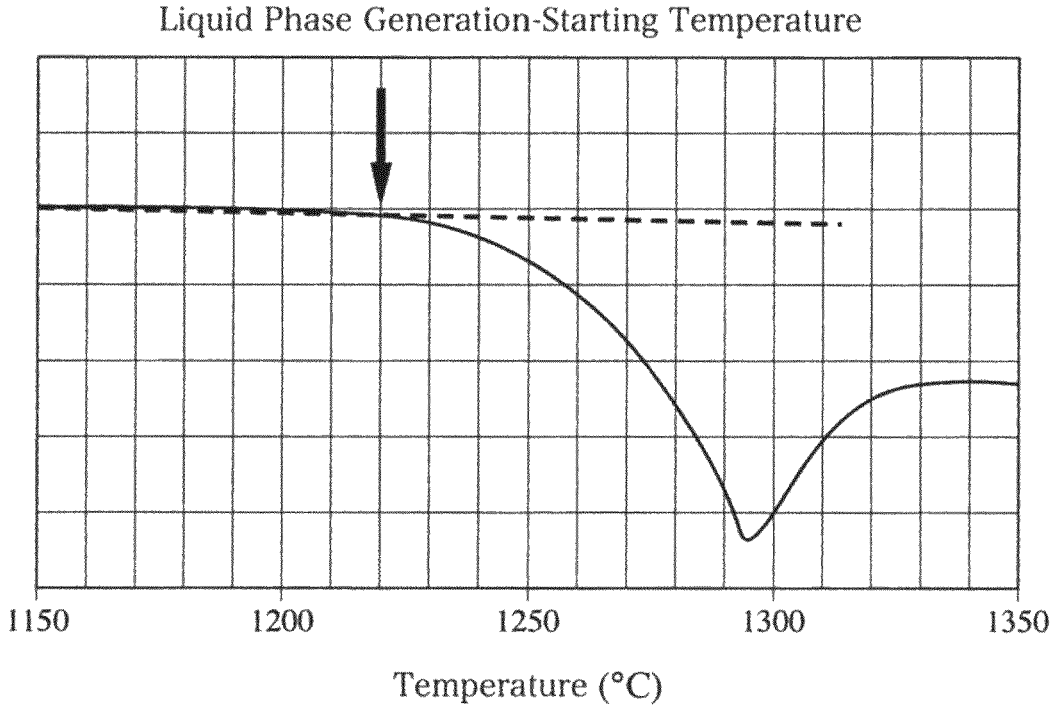
FIG. 4 is a graph showing an example of liquid phase generation-starting temperatures measured by a differential thermal analyzer.

The sleeve-shaped green bodies for the intermediate and outer layers are sintered at a temperature from (liquid phase generation-starting temperature) to (liquid phase generation-starting temperature+100° C.) in vacuum. The liquid phase generation-starting temperature of the green body is a temperature at which the generation of a liquid phase starts in the heating process of sintering, which is measured by a differential thermal analyzer. FIG. 4 shows an example of the measurement results. The liquid phase generation-starting temperature of the green body is a temperature at which an endothermic reaction starts as shown by an arrow in FIG. 4. When sintered at a higher temperature than the liquid phase generation-starting temperature+100° C., coarse composite carbides are formed, providing the resultant cemented carbide with low strength. On the other hand, when sintered at a lower temperature than the liquid phase generation-starting temperature, densification is insufficient, also providing the resultant cemented carbide with low strength. The lower limit of the sintering temperature is preferably the liquid phase generation-starting temperature+10° C., and the upper limit of the sintering temperature is preferably the liquid phase generation-starting temperature+90° C., and more preferably the liquid phase generation-starting temperature+80° C.

(D) HIP Treatment

The sintered bodies are further subjected to a HIP treatment. Specific explanations will be made below in a case where the second composite cemented carbide roll is produced. Incidentally, the production of the first composite cemented carbide roll is the same as that of the second composite cemented carbide roll, except for using no sintered body for the intermediate layer.

Figure 5:
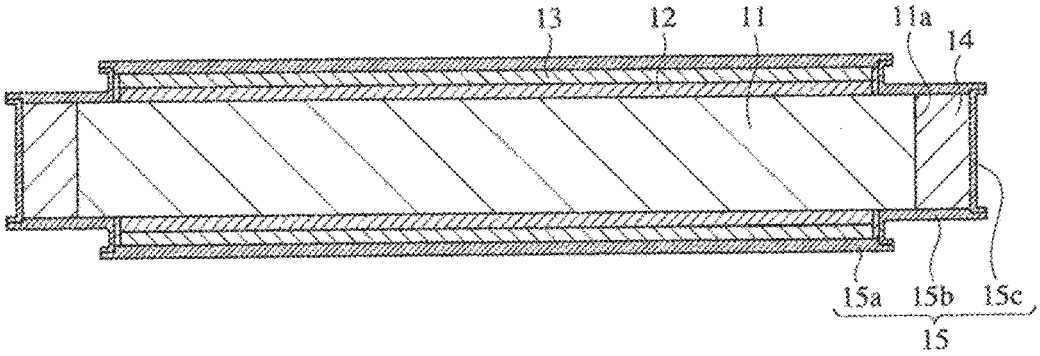
FIG. 5 is a schematic cross-sectional view showing an inner layer, a sintered body for an intermediate layer, a sintered body for an outer layer, and a shaft member, which are sealed in a HIP can.
Figure 6:
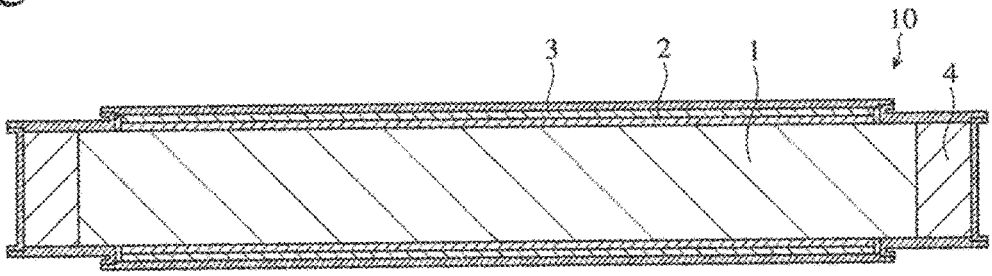
FIG. 6 is a schematic cross-sectional view showing the shape after a HIP treatment.

For the HIP treatment, as shown in FIG. 5, a sleeve-shaped sintered body 12 for an intermediate layer is arranged around an inner layer 11, and a sleeve-shaped sintered body 13 for an outer layer is arranged around the sleeve-shaped sintered body 12 for the intermediate layer, with their inner surfaces in contact with each other. An end surface of a shaft member 14 is abutted on an end surface 11*a* of the inner layer, and a cylindrical HIP can 15*a* is arranged on an outer surface of the sleeve-shaped sintered body 13 for the outer layer. The inner layer 11 and the shaft member 14 are covered with a cylindrical HIP can 15*b* having a flange to be welded to the above cylindrical HIP can, and a disc-shaped HIP can 15*c* is welded to the flanged cylindrical HIP can 15*b*. After evacuating the HIP can through an evacuation pipe (not shown), the evacuation pipe is sealed by welding. Thereafter, the HIP can 15 is placed in a HIP furnace for the HIP treatment. The HIP temperature is preferably 1150-1300° C., and the HIP pressure is preferably 100-140 MPa. The high-alloy inner layer and the shaft member can be well metallurgically bonded to each other by diffusion bonding by HIP, though their welding is difficult. After the HIP treatment, the shapes of the HIP can 15 and the composite cemented carbide roll 10 are shown in FIG. 6.

(E) Cooling

After the HIP treatment, cooling is conducted at an average rate of 60° C./hour or more between 900° C. and 600° C. When cooled at an average rate of less than 60° C./hour, the binder phase in the cemented carbide contains a large percentage of pearlite phases, failing to have 50% or more in total by area of bainite phases and/or martensite phases, thereby providing the cemented carbide with low compressive yield strength. Cooling at an average rate of 60° C./hour or more may be conducted in the cooling process of HIP in a HIP furnace, or after cooling in the HIP furnace and then heating to 900° C. or higher again in another furnace.

(2) Method of Using Green or Calcined Body of Cemented Carbide

Though the above explanations are made on a case where the sleeve-shaped sintered body 12 for the intermediate layer and the sleeve-shaped sintered body 13 for the outer layer are used, sleeve-shaped green bodies of cemented carbide for the intermediate and outer layers, or sleeve-shaped calcined bodies of cemented carbide for the intermediate and outer layers may be used, in place of the sleeve-shaped sintered body 12 for the intermediate layer and the sleeve-shaped sintered body 13 for the outer layer. In a case where the green or calcined bodies are used, too, the composite cemented carbide roll is produced by sealing of the HIP can, the HIP treatment and then cooling, as in a case where the sintered bodies are used.

(3) Method of Using Cemented Carbide Powder

In the present invention, cemented carbide powder may be used for the outer layer (and the intermediate layer). When the cemented carbide powder is used, a HIP can is arranged around an outer peripheral surface of the inner layer 11 with a space therebetween, and a cylindrical partition sheet is placed in the space. the cemented carbide powder for the intermediate layer is charged into a gap between an outer peripheral surface of the inner layer and the partition sheet, and the cemented carbide powder for the outer layer is charged into a gap between the partition sheet and an inner surface of the HIP can. Thereafter, the partition sheet is removed, and the HIP can is sealed with an end surface of the shaft member 14 abutted on the end surface 11*a* of the inner layer. Like in the case of using the sintered body, the HIP treatment and the cooling are then conducted to produce a composite cemented carbide roll. When the intermediate layer is not formed, the cemented carbide powder for the outer layer may be charged into an only space for the outer layer provided around the inner layer 11.

Thus obtained is, as shown in FIG. 6, a composite cemented carbide roll 10 comprising an inner layer 1 made of an iron-based alloy, an outer layer 3 of cemented carbide metallurgically bonded to the inner layer 1 via an intermediate layer 2 of cemented carbide, and a shaft member 4 of an iron-based alloy axially metallurgically bonded to at least one end of the inner layer 1.

To achieve a desired product length, a shaft end member is welded to the end of the shaft member. Because the shaft end member is made of an easily weldable low-alloy material, various welding methods such as arc welding, friction welding, etc. can be conducted. After welding, a stress relief heat treatment may be conducted if necessary.

Figure 7:
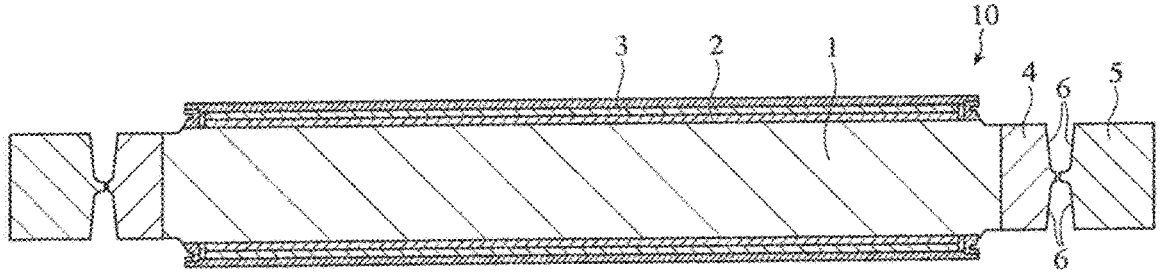
FIG. 7 is a schematic cross-sectional view showing a machined end portion of the shaft member.
Figure 8:
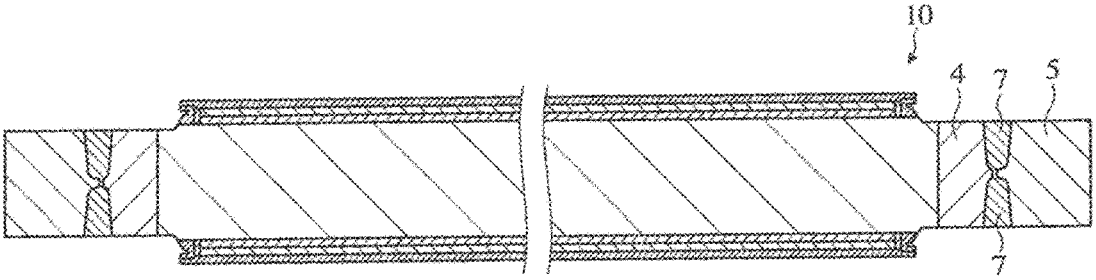
FIG. 8 is a schematic cross-sectional view showing a shaft end member welded to an end of the shaft member.

The present invention is effectively conducted by a step of bonding shaft end member 5 to the shaft member 4 by welding grooves 6 provided in both end portions of the shaft member 4 and the shaft end member 5 as shown in FIG. 7, thereby forming welded portions 7 as shown in FIG. 8, in the composite cemented carbide roll 10. Thus, a longer composite cemented carbide roll than the size received in the HIP furnace can be obtained.

[3] Uses

Because the composite cemented carbide roll of the present invention has an outer layer having high compressive yield strength, bending strength, Young's modulus and hardness, it is particularly suitable for the cold rolling of metal (steel) strips. The composite cemented carbide roll of the present invention is preferably used as a work roll in (a) a 6-roll stand comprising a pair of upper and lower work rolls for rolling a metal strip, a pair of upper and lower intermediate rolls for supporting the work rolls, and a pair of upper and lower backup rolls for supporting the intermediate rolls, or (b) a 4-roll stand comprising a pair of upper and lower work rolls for rolling a metal strip, and a pair of upper and lower backup rolls for supporting the work rolls. At least one stand described above is preferably arranged in a tandem mill comprising pluralities of stands.

The present invention will be explained in further detail by Examples below, without intention of restricting the present invention thereto.

Reference Example 1

WC powder [purity: 99.9%, and D10: 4.3 μm, median diameter D50: 6.4 μm, and D90: 9.0 μm, which were measured by a laser diffraction particle size distribution meter (SALD-2200 available from Shimadzu Corporation)], and a binder phase powder having the composition shown in Table 1 were mixed at ratios shown in Table 2, to prepare powders for molding (Samples 1-10). Each binder phase powder had a median diameter D50 of 1-10 μm, and contained trace amounts of inevitable impurities.

Each of the powders for molding was wet-mixed for 20 hours in a ball mill, dried, and then pressed at pressure of 98 MPa to form a cylindrical green body (Samples 1-10) of 60 mm in diameter and 40 mm in height. The liquid phase generation-starting temperature of a test piece of 1 mm×1 mm×2 mm cut out of each green body was measured by a differential thermal analyzer. The results are shown in Table 3.

TABLE 1

| Sample | Composition of Binder Phase Powder (% by mass) | | | | | | | | |
|---|---|---|---|---|---|---|---|---|---|
| No. | Si | Mn | Ni | Cr | Mo | V | C | Co | Fe[1] |
| 1 | 0.80 | — | 5.02 | 1.21 | — | — | 1.29 | — | Bal. |
| 2 | 0.80 | — | 5.02 | 1.21 | — | — | 1.29 | — | Bal. |
| 3 | 0.81 | — | 5.05 | 1.21 | — | — | 0.79 | — | Bal. |
| 4 | 1.61 | — | 5.02 | 2.41 | — | — | 1.27 | — | Bal. |
| 5 | 0.80 | — | 5.02 | 4.02 | — | — | 1.26 | — | Bal. |
| 6 | 0.80 | — | 2.61 | 3.52 | — | — | 1.29 | — | Bal. |
| 7* | 0.92 | 0.45 | 0.17 | 5.13 | 1.31 | 0.88 | 0.71 | — | Bal. |
| 8* | — | — | 5.43 | — | — | — | 1.30 | — | Bal. |
| 9 | 0.80 | — | 5.00 | 2.40 | — | — | 1.77 | — | Bal. |
| 10* | — | — | 31.13 | 6.67 | — | — | — | Bal. | — |

Note:

*denotes a sample outside the composition of the cemented carbide used in the composite cemented carbide roll of the present invention.

[1]The balance includes inevitable impurities.

TABLE 2

| Sample No. | WC Powder (parts by mass) | Binder Phase Powder (parts by mass) |
|---|---|---|
| 1 | 80 | 20 |
| 2 | 70 | 30 |
| 3 | 70 | 30 |
| 4 | 70 | 30 |
| 5 | 70 | 30 |
| 6 | 70 | 30 |
| 7* | 70 | 30 |
| 8* | 70 | 30 |
| 9 | 70 | 30 |
| 10* | 85 | 15 |

Note:

*denotes a sample outside the composition of the cemented carbide used in the composite cemented carbide roll of the present invention.

TABLE 3

| Sample No. | Liquid Phase Generation-Starting Temperature (° C.) |
|---|---|
| 1 | 1210° C. |
| 2 | 1210° C. |
| 3 | 1230° C. |
| 4 | 1210° C. |
| 5 | 1210° C. |
| 6 | 1210° C. |
| 7* | 1160° C. |
| 8* | 1220° C. |
| 9 | 1200° C. |
| 10* | 1310° C. |

Note:

*denotes a sample outside the composition of the cemented carbide used in the composite cemented carbide roll of the present invention.

Each green body was sintered in vacuum under the conditions shown in Table 4, and then subjected to HIP under the conditions shown in Table 4 to produce the cemented carbides of Samples 1-10. Each cemented carbide was evaluated by the following methods. Incidentally, Samples 7, 8 and 10 are outside the composition of the cemented carbide used in the composite cemented carbide roll of the present invention.

TABLE 4

| | Vacuum Sintering | | HIP Treatment | | | Cooling |
|---|---|---|---|---|---|---|
| Sample No. | Sintering Temperature (° C.) | Holding Time (hour) | Treatment Temperature (° C.) | Pressure (MPa) | Holding Time (hour) | Average Rate [1] (° C./hour) |
| 1 | 1260 | 2 | 1230 | 140 | 2 | 100 |
| 2 | 1260 | 2 | 1230 | 140 | 2 | 100 |
| 3 | 1280 | 2 | 1230 | 140 | 2 | 100 |
| 4 | 1260 | 2 | 1230 | 140 | 2 | 100 |
| 5 | 1260 | 2 | 1230 | 140 | 2 | 100 |
| 6 | 1260 | 2 | 1230 | 140 | 2 | 100 |
| 7* | 1350 | 2 | 1230 | 140 | 2 | 100 |
| 8* | 1330 | 2 | 1230 | 140 | 2 | 100 |
| 9 | 1260 | 2 | 1230 | 140 | 2 | 100 |
| 10* | 1400 | 2 | 1350 | 140 | 2 | 100 |

Note:

*denotes a sample outside the composition of the cemented carbide used in the composite cemented carbide roll of the present invention.

[1]An average cooling rate between 900° C. and 600° C.

(1) Compressive Yield Strength

Each compression test piece shown in FIG. 3 was cut out of each cemented carbide, and a strain gauge was attached to a center portion of a surface thereof to obtain a stress-strain curve under an axial load. In the stress-strain curve, a stress at a point at which the stress and the strain deviated from a straight linear relation was regarded as the compressive yield strength.

The results are shown in Table 5.

(2) Bending Strength

A test piece of 4 mm×3 mm×40 mm cut out of each cemented carbide was measured with respect to bending strength under 4-point bending conditions with an interfulcrum distance of 30 mm. The results are shown in Table 5.

(3) Young's Modulus

The Young's modulus of a test piece of 10 mm in width, 60 mm in length and 1.5 mm in thickness, which was cut out of each cemented carbide, was measured by a free-resonance intrinsic vibration method (JIS Z2280). The results are shown in Table 5.

(4) Hardness

The Rockwell hardness (A scale) of each cemented carbide was measured. The results are shown in Table 5.

TABLE 5

| Sample No. | Compressive Yield Strength (MPa) | Bending Strength (MPa) | Young's Modulus (GPa) | Hardness (HRA) |
|---|---|---|---|---|
| 1 | 1780 | 2574 | 534 | 86.1 |
| 2 | 1800 | 2714 | 496 | 84.4 |
| 3 | 1550 | 2490 | 496 | 84.2 |
| 4 | 1720 | 2126 | 496 | 84.3 |
| 5 | 1700 | 1766 | 496 | 82.6 |
| 6 | 2000 | 2019 | 496 | 85.1 |
| 7* | 2200 | 1470 | 494 | 85.1 |
| 8* | 300 | 1786 | 496 | 79.4 |
| 9 | 1680 | 1430 | 496 | 84.2 |
| 10* | 400 | 2580 | 535 | 84.2 |

Note:

*denotes a sample outside the composition of the cemented carbide used in the composite cemented carbide roll of the present invention.

(5) Observation of Structure

Each sample was mirror-polished, and observed by SEM to determine the presence or absence of composite carbides, and the total area ratio of bainite phases and martensite phases in the binder phase. The results are shown in Table 6. FIG. 1 is a SEM photograph of the cemented carbide of Sample 2, in which white particles are WC particles, and gray portions are a binder phase.

TABLE 6

| Sample No. | Bainite Phases and/or Martensite Phases(1) | Composite Carbides(2) |
|---|---|---|
| 1 | 50% or more by area | No |
| 2 | 50% or more by area | No |
| 3 | 50% or more by area | No |
| 4 | 50% or more by area | No |
| 5 | 50% or more by area | No |
| 6 | 50% or more by area | No |

TABLE 6-continued

| Sample No. | Bainite Phases and/or Martensite Phases(1) | Composite Carbides(2) |
|---|---|---|
| 7* | 50% or more by area | Yes |
| 8* | Less than 50% by area | No |
| 9 | 50% or more by area | Yes |
| 10* | Not evaluated | No |

Note:

*denotes a sample outside the composition of the cemented carbide used in the composite cemented carbide roll of the present invention.

(1)The total area ratio (%) of bainite phases and martensite phases in the binder phase.

(2)The presence or absence of composite carbides having diameters of 5 μm or more in the binder phase.

(6) Composition of Binder Phase

The composition of the binder phase in each sample was measured by a field emission electron probe microanalyzer (FE-EPMA). Point analysis was conducted with a beam diameter of 1 μm at 10 arbitrary points in portions other than WC particles, and the measured values were averaged to determine the composition of the binder phase. When there were composite carbides having diameters of 5 μm or more, other portions than WC particles and composite carbides were measured. The results are shown in Table 7.

TABLE 7

| Sample | Composition of Binder Phase (% by mass)(1) | | | | | | | | | |
|---|---|---|---|---|---|---|---|---|---|---|
| No. | Si | Mn | Ni | Cr | W | Mo | V | C | Co | Fe(2) |
| 1 | 0.91 | — | 4.92 | 0.89 | 1.60 | — | — | 0.81 | — | Bal. |
| 2 | 0.93 | — | 4.89 | 0.94 | 1.63 | — | — | 0.83 | — | Bal. |
| 3 | 0.84 | — | 4.82 | 0.94 | 2.29 | — | — | 0.69 | — | Bal. |
| 4 | 1.84 | — | 4.84 | 1.75 | 1.47 | — | — | 0.74 | — | Bal. |
| 5 | 0.90 | — | 4.92 | 3.39 | 1.65 | — | — | 0.88 | — | Bal. |
| 6 | 0.84 | — | 2.60 | 2.82 | 1.70 | — | — | 0.88 | — | Bal. |
| 7* | 0.70 | 0.24 | 0.19 | 4.03 | 1.48 | 0.17 | 0.14 | 0.70 | — | Bal. |
| 8* | — | — | 4.83 | — | 1.15 | — | — | 0.31 | — | Bal. |
| 9 | 0.97 | — | 5.10 | 0.70 | 1.11 | — | — | 0.88 | — | Bal. |
| 10* | — | — | 31.27 | 6.53 | — | — | — | — | Bal. | — |

Note:

*denotes a sample outside the composition of the cemented carbide used in the composite cemented carbide roll of the present invention.

(1)Analyzed values.

(2)The balance includes inevitable impurities.

Reference Example 2

Using a powder for molding having the same composition as that of Sample 1 in Reference Example 1, solid cylindrical green bodies were formed by the same method as in Reference Example 1. Each green body was sintered in the same manner as in Reference Example 1 to form an integral roll of 44 mm in outer diameter and 620 mm in length. Using this roll, a pure-Ni strip as thick as 0.6 mm was cold-rolled without suffering defects due to dents on the roll surface.

Using a powder for molding having the same composition as that of Sample 10 in Reference Example 1, an integral roll of 44 mm in outer diameter and 620 mm in length was similarly formed. Using this roll, a pure-Ni strip as thick as 0.6 mm was rolled without suffering defects due to dents on the roll surface.

Example 1

Using the same material as that of Sample 1 in Reference Example 1, powder for molding having the composition shown in Table 8 was prepared, and formed into sleeve-shaped green bodies for outer and intermediate layers in the same manner as in Sample 1 in Reference Example 1. Like Sample 1 in Reference Example 1, the green bodies were sintered in vacuum, to produce a sleeve-shaped sintered body (outer diameter:194 mm, inner diameter: 171 mm, and length: 1050 mm) for the outer layer, and a sleeve-shaped sintered body (outer diameter:171 mm, inner diameter: 152 mm, and length: 1050 mm) for the intermediate layer.

TABLE 8

| | WC | Composition of Binder Phase Powder (% by mass)[2] | | | | |
|---|---|---|---|---|---|---|
| Example 1 | (% by mass)[1] | Ni | Cr | Si | C | Fe[3] |
| Outer Layer | 70 | 5.0 | 1.2 | 0.8 | 1.3 | Bal. |
| Intermediate Layer | 50 | 5.0 | 1.2 | 0.8 | 1.3 | Bal. |

[1]A ratio (% by mass) per the total amount of WC powder and the binder phase powder.
[2]The percentage of each metal in the binder phase powder.
[3]The balance includes inevitable impurities.

As shown in FIG. 5, the sleeve-shaped sintered body 12 for the intermediate layer was arranged around the solid cylindrical inner layer 11 made of SNCM439 (outer diameter: 152 mm, and length: 1150 mm), and the sleeve-shaped sintered body 13 for the outer layer was arranged around the sleeve-shaped sintered body 12, with shaft members 14 made of S45C (outer diameter: 152 mm, and length: 80 mm) abutted on both ends of the inner layer. An outer surface of the sleeve-shaped sintered body 13 for the outer layer was covered with a cylindrical HIP can, and the inner layer 11 and the shaft members 14 were covered with cylindrical HIP cans each having a flange welded to the above cylindrical HIP can, and further a disc-shaped HIP can was welded to each flanged cylindrical HIP can. Thereafter, the HIP can was evacuated through an evacuation pipe (not shown), and the evacuation pipe was welded to seal the HIP can.

With the HIP can placed in a HIP furnace, HIP was conducted at 1230° C. and 140 MPa. The HIPed outer and intermediate layers were cooled at an average rate of 80-100° C./hour.

Thus obtained was, as shown in FIG. 6, a composite cemented carbide roll 10 comprising the inner layer 1 made of an iron-based alloy, and the outer layer 3 of cemented carbide metallurgically bonded to the inner layer 1 via the intermediate layer 2 of cemented carbide, the shaft members 4 made of an iron-based alloy being axially metallurgically bonded to both ends of the inner layer 1. The compositions of the binder phases in the intermediate layer 2 and the outer layer 3 of this composite cemented carbide roll 10 were measured in the same manner as in Reference Example 1. The results are shown in Table 9.

TABLE 9

| | Composition of Binder Phase (% by mass)[1] | | | | | |
|---|---|---|---|---|---|---|
| Example 1 | Ni | Cr | W | Si | C | Fe[2] |
| Outer Layer | 4.93 | 0.94 | 1.59 | 0.92 | 0.83 | Bal. |
| Intermediate Layer | 4.96 | 0.94 | 1.58 | 0.92 | 0.76 | Bal. |

[1]Analyzed values.
[2]The balance includes inevitable impurities.

In the outer layer 3 of this composite cemented carbide roll 10, the measurement of its compressive yield strength, bending strength, Young's modulus and hardness, and the observation of its structure were conducted in the same manner as in Reference Example 1. The results are shown in Tables 10 and 11.

TABLE 10

| Example 1 | Compressive Yield Strength (MPa) | Bending Strength (MPa) | Young's Modulus (GPa) | Hardness (HRA) |
|---|---|---|---|---|
| Outer Layer | 1700 | 2552 | 414 | 83.2 |

TABLE 11

| Example 1 | Bainite Phases and/or Martensite Phases [1] | Composite Carbides [2] |
|---|---|---|
| Outer Layer | 50% or more by area | No |

[1]The total area ratio (%) of bainite phases and martensite phases in the binder phase.
[2]The presence or absence of composite carbides having diameters of 5 μm or more in the binder phase.

As shown in FIG. 7, end portions of the shaft members 4 of this composite cemented carbide roll 10 were provided with grooves 6, and a shaft end member 5 made of S45C (outer diameter: 152 mm, and length: 300 mm), which was provided with a groove 6, was abutted on the end portion of each shaft member 4 having a groove 6. With these grooves 6 welded to form welded portions 7 as shown in FIG. 8, the shaft end members 5 were connected to the shaft members 4. After removing the HIP can by machining, the outer surface was machined to obtain a composite cemented carbide roll of 190 mm in outer diameter, 900 mm in outer and intermediate layer length, and 1850 mm in total length.

Example 2

A sleeve-shaped sintered body (outer diameter: 298 mm, inner diameter: 264 mm, and length: 1720 mm) for an outer layer and a sleeve-shaped sintered body (outer diameter: 264 mm, inner diameter: 254 mm, and length: 1720 mm) for an intermediate layer were produced in the same manner as in Example 1, except for preparing powder for molding having the composition shown in Table 12.

TABLE 12

| | WC[1] | Composition of Binder Phase Powder[2] (% by mass) | | | | |
|---|---|---|---|---|---|---|
| Example 2 | (% by mass) | Ni | Cr | Si | C | Fe[3] |
| Outer Layer | 80 | 5.0 | 1.2 | 0.8 | 1.3 | Bal. |
| Intermediate Layer | 50 | 5.0 | 1.2 | 0.8 | 1.3 | Bal. |

[1]A ratio per the total amount of WC powder and the binder phase powder.
[2] The percentage of each metal in the binder phase powder.
[3]The balance includes inevitable impurities.

As shown in FIG. 5, the sleeve-shaped sintered body 12 for the intermediate layer was arranged around an outer peripheral surface of the solid cylindrical inner layer 11 made of SNCM630 (outer diameter: 245 mm, and length: 2150 mm), and the sleeve-shaped sintered body 13 for the outer layer was arranged therearound, with the shaft members 14 made of SCM440 (outer diameter: 245 mm, and length: 500 mm) abutted on both ends of the inner layer. The resultant assembly was sealed in a HIP can in the same manner as in Example 1.

With the HIP can placed in a HIP furnace, a HIP treatment was conducted at 1230° C. and 140 MPa. After the HIP treatment, the outer layer and the intermediate layer were cooled at an average rate of 80-100° C./hour.

Thus obtained was, as shown in FIG. 6, a composite cemented carbide roll 10 comprising an inner layer 1 made of an iron-based alloy, and an outer layer 3 of cemented carbide metallurgically bonded to the inner layer 1 via an intermediate layer 2 of cemented carbide, with shaft members 4 of an iron-based alloy axially metallurgically bonded to both ends of the inner layer 1. The compositions of the binder phases in the intermediate layer 2 and the outer layer 3 of this composite cemented carbide roll 10 were measured in the same manner as in Reference Example 1. The results are shown in Table 13.

TABLE 13

| | Composition of Binder Phase (% by mass)[1] | | | | | |
|---|---|---|---|---|---|---|
| Example 2 | Ni | Cr | W | Si | C | Fe[2] |
| Outer Layer | 4.92 | 0.89 | 1.63 | 0.91 | 0.81 | Bal. |
| Intermediate Layer | 4.92 | 0.89 | 1.60 | 0.91 | 0.81 | Bal. |

[1]Analyzed values.
[2]The balance includes inevitable impurities.

As shown in FIG. 7, end portions of the shaft members 4 of this composite cemented carbide roll 10 were provided with grooves 6, and a shaft end member 5 made of SCM440 (outer diameter: 245 mm, and length: 300 mm), which was provided with a groove 6, was abutted on the end portion of each shaft member 4 having a groove 6. With these grooves 6 welded to form welded portions 7 as shown in FIG. 8, the shaft end members 5 were connected to the shaft members 4. After removing the HIP can by machining, the outer surface was machined to obtain a composite cemented carbide roll of 295 mm in outer diameter, 1600 mm in outer and intermediate layer length, and 3700 mm in total length.

What is claimed is:

1. A composite cemented carbide roll comprising an inner layer made of an iron-based alloy, and an outer layer made of cemented carbide which is metallurgically bonded to an outer peripheral surface of said inner layer;

the cemented carbide forming said outer layer comprising 55-90 parts by mass of WC particles and 10-45 parts by mass of an Fe-based binder phase, and said binder phase in said outer layer having a chemical composition comprising 0.5-10% by mass of Ni, 0.2-2.0% by mass of C, 0.5-5% by mass of Cr, and 0.1-5% by mass of W, the balance being Fe and inevitable impurities;

a shaft member being metallurgically bonded to at least one axial end of said inner layer, and a shaft end member being welded to said shaft member;

said inner layer being made of an iron-based alloy comprising 0.2-0.45% by mass of C, 0.5-4.0% by mass of Cr, 1.4-4.0% by mass of Ni, and 0.10-1.0% by mass of Mo, the balance being Fe and inevitable impurities; and said shaft member and said shaft end member being made of an iron-based alloy containing 1.5% or less in total by mass of at least one selected from the group consisting of Cr, Ni and Mo.

2. The composite cemented carbide roll according to claim 1, wherein the cemented carbide forming said outer layer contains substantially no composite carbides having equivalent circle diameters of 5 μm or more.

3. The composite cemented carbide roll according to claim 1, wherein said WC particles in the cemented carbide forming said outer layer have a median diameter D50 of 0.5-10 μm.

4. The composite cemented carbide roll according to claim 1, wherein the binder phase in the cemented carbide forming said outer layer further comprises 0.2-2.0% by mass of Si, 0-5% by mass of Co, and 0-1% by mass of Mn.

5. The composite cemented carbide roll according to claim 1, wherein the binder phase in the cemented carbide forming said outer layer further comprises 0.2-2.0% by mass of Si, 0-5% by mass of Co, and 0-1% by mass of Mn.

6. A composite cemented carbide roll comprising an inner layer made of an iron-based alloy, an intermediate layer made of cemented carbide which is metallurgically bonded to an outer peripheral surface of said inner layer, and an outer layer made of cemented carbide which is bonded to an outer peripheral surface of said intermediate layer;

the cemented carbide forming said outer layer comprising 55-90 parts by mass of WC particles and 10-45 parts by mass of an Fe-based binder phase, and said binder phase in said outer layer having a chemical composition comprising 0.5-10% by mass of Ni, 0.2-2.0% by mass of C, 0.5-5% by mass of Cr, and 0.1-5% by mass of W, the balance being Fe and inevitable impurities;

the cemented carbide forming said intermediate layer comprising 30-65 parts by mass of WC particles and 35-70 parts by mass of an Fe-based binder phase, and said binder phase of said intermediate layer having a chemical composition comprising 0.5-10% by mass of Ni, 0.2-2.0% by mass of C, 0.5-5% by mass of Cr, and 0.1-5% by mass of W, the balance being Fe and inevitable impurities;

a shaft member being metallurgically bonded to at least one axial end of said inner layer, and a shaft end member being welded to said shaft member;

said inner layer being made of an iron-based alloy comprising 0.2-0.45% by mass of C, 0.5-4.0% by mass of Cr, 1.4-4.0% by mass of Ni, and 0.10-1.0% by mass of Mo, the balance being Fe and inevitable impurities; and said shaft member and said shaft end member being made of an iron-based alloy containing 1.5% or less in total by mass of at least one selected from the group consisting of Cr, Ni and Mo.

7. The composite cemented carbide roll according to claim 6, wherein the cemented carbide forming said outer layer and/or said intermediate layer contains substantially no composite carbides having equivalent circle diameters of 5 μm or more.

8. The composite cemented carbide roll according to claim 6, wherein said WC particles contained in the cemented carbide forming said outer layer and/or said intermediate layer have a median diameter D50 of 0.5-10 μm.

9. The composite cemented carbide roll according to claim 6, wherein the binder phase in the cemented carbide forming said outer layer and/or said intermediate layer further comprises 0.2-2.0% by mass of Si, 0-5% by mass of Co, and 0-1% by mass of Mn.

10. The composite cemented carbide roll according to claim 6, wherein the amount of bainite phases and/or martensite phases in the binder phases in the cemented carbide forming said outer layer and/or said intermediate layer is 50% or more by area in total.

11. The composite cemented carbide roll according to claim 1, wherein said shaft member and said shaft end member are made of an iron-based alloy comprising 0.2-0.58% by mass of C, 0-1.2% by mass of Cr, and 0-0.3% by mass of Mo, the balance being Fe and inevitable impurities.

12. A method for producing a composite cemented carbide roll comprising an inner layer made of an iron-based alloy and an outer layer made of cemented carbide metallurgically bonded to each other; said method comprising:

arranging an outer layer material, which is a powder, green body, calcined body or sintered body of cemented carbide, around said inner layer made of an iron-based alloy comprising 0.2-0.45% by mass of C, 0.5-4.0% by mass of Cr, 1.4-4.0% by mass of Ni, and 0.10-1.0% by mass of Mo, the balance being Fe and inevitable impurities;

abutting a shaft member made of an iron-based alloy containing 1.5% or less in total by mass of at least one selected from the group consisting of Cr, Ni and Mo on at least one axial end of said inner layer;

sealing said outer layer material, said inner layer and said shaft member in a HIP can made of a steel material, and evacuating said HIP can; and conducting a HIP treatment to integrally bond said outer layer, said inner layer and said shaft member.

13. The method for producing a composite cemented carbide roll according to claim 12, wherein the cemented carbide forming said outer layer comprises 55-90 parts by mass of WC particles and 10-45 parts by mass of an Fe-based binder phase, the binder phase in said outer layer having a chemical composition comprising 0.5-10% by mass of Ni, 0.2-2.0% by mass of C, 0.5-5% by mass of Cr, and 0.1-5% by mass of W, the balance being Fe and inevitable impurities.

14. A method for producing a composite cemented carbide roll comprising an inner layer made of an iron-based alloy, an intermediate layer made of cemented carbide and an outer layer made of cemented carbide, which are metallurgically bonded to each other; said method comprising:

arranging an intermediate layer material which is a powder, green body, calcined body or sintered body of cemented carbide, and an outer layer material which is a powder, green body, calcined body or sintered body of cemented carbide, around the inner layer made of an iron-based alloy comprising 0.2-0.45% by mass of C, 0.5-4.0% by mass of Cr, 1.4-4.0% by mass of Ni, and 0.10-1.0% by mass of Mo, the balance being Fe and inevitable impurities;

abutting a shaft member made of an iron-based alloy containing 1.5% or less in total by mass of at least one selected from the group consisting of Cr, Ni and Mo on at least one axial end of said inner layer;

sealing said outer layer material, said intermediate layer material, said inner layer and said shaft member in a HIP can made of a steel material, and evacuating said HIP can;

conducting a HIP treatment to integrally bond said outer layer material, said intermediate layer material, said inner layer, and said shaft member.

15. The method for producing a composite cemented carbide roll according to claim 14, wherein the cemented carbide forming said outer layer comprises 55-90 parts by mass of WC particles and 10-45 parts by mass of an Fe-based binder phase, the binder phase in said outer layer having a chemical composition comprising 0.5-10% by mass of Ni, 0.2-2.0% by mass of C, 0.5-5% by mass of Cr, and 0.1-5% by mass of W, the balance being Fe and inevitable impurities; and the cemented carbide forming said intermediate layer comprises 30-65 parts by mass of WC particles and 35-70 parts by mass of an Fe-based binder phase, the binder phase in said intermediate layer having a chemical composition comprising 0.5-10% by mass of Ni, 0.2-2.0% by mass of C, 0.5-5% by mass of Cr, and 0.1-5% by mass of W, the balance being Fe and inevitable impurities.

16. The method for producing a composite cemented carbide roll according to claim 12, wherein after said HIP treatment, a shaft end member made of an iron-based alloy containing 1.5% or less in total by mass of at least one selected from the group consisting of Cr, Ni and Mo is welded to said shaft member.

17. The composite cemented carbide roll according to claim 6, wherein said shaft member and said shaft end member are made of an iron-based alloy comprising 0.2-0.58% by mass of C, 0-1.2% by mass of Cr, and 0-0.3% by mass of Mo, the balance being Fe and inevitable impurities.

18. The method for producing a composite cemented carbide roll according to claim 14, wherein after said HIP treatment, a shaft end member made of an iron-based alloy containing 1.5% or less in total by mass of at least one selected from the group consisting of Cr, Ni and Mo is welded to said shaft member.

* * * * *